US007020408B2

(12) United States Patent
Lester et al.

(10) Patent No.: US 7,020,408 B2
(45) Date of Patent: Mar. 28, 2006

(54) SECURE PRINT PRODUCTION COST ACCOUNTING

(75) Inventors: Samuel M. Lester, Boise, ID (US); Jimmy Sfaelos, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 111 days.

(21) Appl. No.: 10/732,065

(22) Filed: Dec. 10, 2003

(65) Prior Publication Data

US 2005/0129423 A1 Jun. 16, 2005

(51) Int. Cl.
*G03G 21/02* (2006.01)

(52) U.S. Cl. ..... 399/79; 399/8; 399/80

(58) Field of Classification Search ..... 399/8, 399/9, 38, 42, 75, 79, 80, 81; 358/1.15, 1.18, 358/1.17, 1.16; 364/461.1; 379/91.1, 100.04, 379/91.01; 395/200.33; 705/1, 30
See application file for complete search history.

(56) References Cited

U.S. PATENT DOCUMENTS 5,146,344 A 9/1992 Bennett et al.
5,383,129 A 1/1995 Farrell
5,604,578 A * 2/1997 Shibuya et al. ..... 399/178
5,745,883 A 4/1998 Krist et al.
6,064,838 A 5/2000 Maruta et al.
6,112,039 A 8/2000 Salgado et al.
6,385,675 B1 5/2002 Yamaguchi
6,457,640 B1 10/2002 Ramachandran et al.
6,516,157 B1 2/2003 Maruta et al.
6,629,753 B1 * 10/2003 Usui ..... 347/43
6,862,110 B1 * 3/2005 Harrington ..... 358/1.9
2004/0190014 A1 * 9/2004 Ferlitsch ..... 358/1.5

* cited by examiner

*Primary Examiner*—Hoan Tran

(57) ABSTRACT

Various systems, methods, and programs embodied in computer readable mediums are provided for print production cost accounting. In one embodiment, a pre-print cost of a print production of a document by an image forming device is stored in a memory. The print production of the document by the image forming device is initiated after the pre-print cost is stored in the memory. Then, a post-print cost of the print production of the document by the image forming device is generated if the print production of the document is completed. A user is charged the post-print cost if the post-print cost is available before the pre-print cost has been stored in the memory for a predefined period of time.

18 Claims, 4 Drawing Sheets

SECURE PRINT PRODUCTION COST ACCOUNTING

BACKGROUND

Image forming devices like printers and copiers are often used in environments where multiple users have access to them. For example, such devices may be employed in libraries, computer labs in schools and the like, and in other similar locations. In these environments, it is often desirable for costs of use of such image forming devices be tracked and charged to users. While the costs of use of such devices may be tracked and stored within the image forming devices themselves, such an approach presents a problem. In particular, users may tamper with the operation of such devices and prevent the costs associated with their use from being accessed. For example, a user may shut down the device just before a print production is complete, thereby preventing the assessment of charges for the print production.

BRIEF DESCRIPTION OF THE DRAWINGS

The invention can be understood with reference to the following drawings. The components in the drawings are not necessarily to scale. Also, in the drawings, like reference numerals designate corresponding parts throughout the several views.

DETAILED DESCRIPTION

Figure 1:
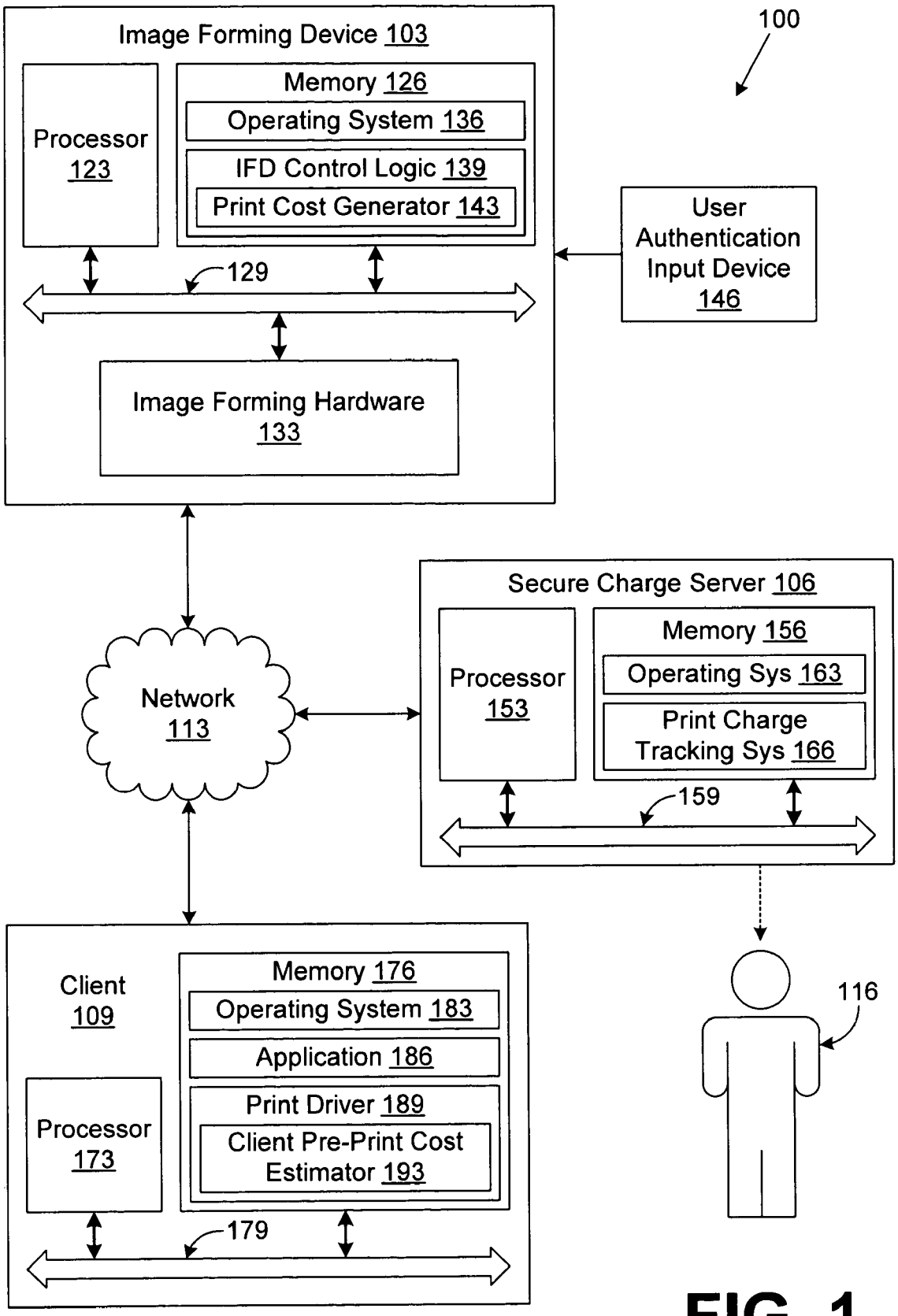
FIG. 1 is a block diagram that illustrates a print production network upon which a print cost accounting is performed according to various embodiments of the present invention.

With reference to FIG. 1, shown is a print production network 100 according to an embodiment of the present invention. In this respect, the print production network 100 includes an image forming device 103, a secure charge server 106, and a client 109. The image forming device 103, secure charge server 106, and the client 109 are each coupled to each other through network 113. In this respect, the image forming device 103, secure charge server 106, and the client 109 are in data communication with each other. The network 113 may include, for example, the Internet, intranets, wide area networks (WANs), local area networks, wireless networks, or other suitable networks, etc., or any combination of two or more such networks.

For purposes of the discussion that follows, first a description of the general hardware of the print production network 100 is described followed by a description of the operation of various components therein according to the various embodiments of the present invention. To begin, the image forming device 103 may be, for example, a printer, copier, multifunction peripheral, or other type of image forming device 103. In this respect, the image forming device 103 includes a processor circuit having a processor 123 and a memory 126, both of which are coupled to a local interface 129. The local interface 129 may comprise, for example, a data bus with an accompanying control/address bus as can be appreciated with those with ordinary skill in the art.

The image forming device 103 also includes image forming hardware 133 that is controlled to accomplish a print production of a document. In this respect, the terms "print production" refers to the creation of one or more copies or prints of a document on a prescribed print media. Thus, a print production may involve the printing of a document expressed as a digital file from the client 109 or a digital representation of a document scanned by the image forming device 103. Also, a print production may involve the copying of a document using the image forming device 103. In this respect, the image forming hardware 133 may include an input bin into which documents, as expressed on a print media, may be placed for copying as will be described. Thus, as contemplated herein, the term "document" refers to a collection of images and/or text on one or more pages embodied in the form of a digital file or expressed on a print medium.

In addition, the image forming hardware 133 may include equipment to facilitate a paper path for the movement of paper documents, as well as equipment that generates images on print media, as directed by documents provided to the image forming device 103 in digital form. For example, the image forming hardware 133 may comprise a laser printing system, an ink jet printing system, a photocopying system, or other appropriate hardware.

Stored on the memory 126 and executable by the processor 123 are a number of software/firmware components including, for example, an operating system 136 and image forming device control logic 139. The image forming device control logic 139 is executed to control the functions of the image forming hardware 133 in producing a print production of a document. The image forming device control logic 139 also includes a print cost generator 143. The print cost generator 143 is executed to generate pre-print costs and post-print costs associated with various print productions of documents as will be described.

Associated with the image forming device 103 is a user authentication input device 146. The user authentication input device 146 allows a user 116 to approach the image forming device 103 and authenticate themselves so that any charges generated for a print production performed on behalf of the user 116 can be charged to the particular user 116. The user authentication input device 146 may comprise, for example, a keypad that allows a user to enter a password, a user identifier, a username, or other information associated with the user. Alternatively, the user authentication input device 146 may also include biometric input devices 146 such as fingerprint scanners, retinal scanners, voice recognition equipment, or other such devices as can be appreciated by those with ordinary skill in the art. The image forming device logic 139 includes logic that interfaces with the user authentication input device 146 to authenticate a particular user. In this respect, the image forming device control logic 139 may interface with a separate server on the network 113 that warehouses authentication information associated with users 116, as can be appreciated by those with ordinary skill in the art.

The secure charge server 106 may be, for example, a server, computer system, or other device with like capability. In this respect, the secure charge server 106 includes a processor 153 and a memory 156, both of which are coupled to a local interface 159. In this respect, the local interface 159 may comprise, for example, a data bus with an accompanying control/address bus as can be appreciated by those with ordinary skill in the art.

Stored on the memory 156 and executable by the processor 153 are a number of software components including, for example, an operating system 163 and a print charge tracking system 166. The print charge tracking system 166 is executed by the processor 153 to charge costs for the print productions performed on the image forming device 103 to users 116 as will be described.

The client 109 may be, for example, a computer system, laptop, personal digital assistant, or other device with like capability. In this respect, the client 109 includes a processor 173 and a memory 176, both of which are coupled to a local interface 179. In this respect, the local interface 179 may be, for example, a data bus with an accompanying control/address bus as can be appreciated by those with ordinary skill in the art. Stored in the memory 176 and executable by the processor 173 are a number of software components such as, for example, an operating system 183, one or more applications 186, and a print driver 189. According to one embodiment of the present invention, the print driver 189 includes a client pre-print cost estimator 193. The client pre-print cost estimator 193 is executed to estimate a pre-print cost for a print production of a document on the image forming device 103, where the document is embodied in the form of a digital file that may be generated by an application 186 on the client 109 or may be obtained from some other source as can be appreciated by those with ordinary skill in the art.

As contemplated herein, the term "executable" means a program file that is in a form that can ultimately be run by a processor. Examples of executable programs may be, for example, a compiled program that can be translated into machine code in a format that can be loaded into a random access portion of a memory and run by a processor, or source code that may be expressed in proper format such as object code that is capable of being loaded into a of random access portion of a memory and executed by a processor, etc. An executable program may be stored in any portion or component of a memory including, for example, random access memory, read-only memory, a hard drive, compact disk (CD), floppy disk, or other memory components.

In addition, each of the memories 126, 156, and 176 is defined herein as both volatile and nonvolatile memory and data storage components. Volatile components are those that do not retain data values upon loss of power. Nonvolatile components are those that retain data upon a loss of power. Thus, each of the memories 126, 156, and 176 may comprise, for example, random access memory (RAM), read-only memory (ROM), hard disk drives, floppy disks accessed via an associated floppy disk drive, compact discs accessed via a compact disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

In addition, although each of the memories 126, 156, and 176 are shown in close proximity to their respective processors 123, 153, and 173, respectively, the memories 126, 156, and 176 may be located remote to the processors 123, 153, and 173 and accessed, for example, via the network 113.

Also, each of the processors 123, 153, and 173 may represent multiple processors and each of the memories 126, 156, and 176 may represent multiple memories that operate in parallel processing circuits, respectively. In such a case, each of the local interfaces 129, 159, and 179 may be an appropriate network that facilitates communication between any two of the multiple processors, between any processor and any of the memories, or between any two of the memories, etc. The processors 123, 153, and 173 may be of electrical, optical, or molecular construction, or of some other construction as can be appreciated by those with ordinary skill in the art.

Each of the operating systems 136, 163, and 183 is executed to control the allocation and usage of hardware resources such as the memory, processing time, peripheral devices, and subsystems in the image forming device 103, secure charge server 106, and the client 109. In this manner, each of the operating systems 136, 163, and 183 serve as the foundation on which applications depend as is generally known by those with ordinary skill in the art.

Next, a discussion of the operation of the various components within the print production network is provided according to the various embodiments of the present invention. Assume that a user 116 wishes to perform a print production of a document. In this respect, the document may be embodied in hardcopy form on a particular print media. In such case, the print production of the document may comprise, for example, copying the document using the image forming device 103. In this respect, the user 116 may approach the image forming device 103 and place the document in an appropriate input bin. The user may then manipulate the user authentication input device 146 to authenticate themselves to the image forming device 103 so that it may know who is to be charged for the copying that is to be done. Once the user has been authenticated, then the print cost generator 143 is executed as a portion of the image forming device control logic 139 to estimate a pre-print cost of the print production of the document by the image forming device 103.

Alternatively, the user 116 may wish to perform a print production of a document that was generated in digital form by an application 186 in the client 109. In this respect, the document is transmitted in digital form for printing by the image forming device 103. The client pre-print cost estimator 193 is executed as a part of the print driver 189, for example, in the client 109 in order to estimate a pre-print cost of the print production of the document by the image forming device 103 in a similar manner as is performed in the print cost generator 143 discussed above.

Regardless of where the pre-print cost is determined by the print cost generator 143 or the client pre-print cost estimator 193, the pre-print cost is estimated taking into account a number of cost factors. For example, if the print production involves copying a document in hardcopy form at the image forming device 103 by the user 116, then the estimation of the pre-print cost may involve estimating a number of pages in the document as it is disposed in a stack in the input bin of the image forming device 103. If the estimate of the pre-print cost is generated by the client pre-print cost estimator 193, the number of changes may be determined from the digital document itself. Also, other cost factors that are associated with the print production of the document to be performed that may be taken into account when calculating the pre-print cost include, for example, a type of print media designated for use in the print production, the size of the print media, an estimated amount of at least one marking agent that may be employed in the print production, any finishing operations performed as part of the print production, and other cost factors. A "marking agent" is defined herein as being either ink, toner, or other agent that is employed to generate images on print media. In addition, finishing operations may comprise, for example, stapling documents, binding documents, or other finishing operations.

Once an estimate of the pre-print costs are determined, either the print cost generator 143 or the client pre-print cost estimator 193 transmits the pre-print cost to the print charge tracking system 166 in the secure charge server 106. The print charge tracking system 166 stores the pre-print cost for the print production in an appropriate portion of the memory 156. In sending the pre-print cost to the print charge tracking system 166, the print cost generator 143 or client pre-print cost estimator 193 may generate a message that associates the pre-print cost with a user account or identifier, and with the print production to be performed. In this respect, an identifier may be associated with the print production by the print cost generator 143 or the client pre-print cost estimator 193 that uniquely identifies the print production to be performed, whether it is a copying of a document or the printing of a document as described above. The message generated may employ a suitable language or syntax such as, for example, extensible Markup Language (XML) or other language or syntax.

The fact that the pre-print cost is transmitted and stored in the secure charge server 106 ensures that the pre-print cost is stored in a secure location that is inaccessible by the user 116. This is advantageous in that the pre-print cost that was estimated is available to charge to a user in the event that user 116 tampers with the operation of the image forming device 103 to prevent a post-print cost from being generated. Also, other circumstances may arise that prevent the post-print cost from being generated and/or transmitted to the secure charge server 106 by the image forming device 103 for a particular print production. For example, the data communications pathway between the image forming device 103 and the network 113 may be compromised, etc.

After the pre-print cost has been transmitted to the secure charge server 106 and stored in the memory 156, the print cost generator 143 initiates the print production of the document by the image forming device 103. Assuming that the client pre-print cost estimator 193 already transmitted the pre-print cost to the secure charge server 106, then the print cost generator 143 immediately initiates the print production of the document as the pre-print cost has already been transmitted and stored in the memory 156 of the secure charge server 106.

It may be possible that the user might initiate the performance of the print production from the client 109 without the client pre-print cost estimator 193 as part of the print driver 189. In such case, when the image forming device 103 receives the document to be printed, the print cost generator 143 estimates the pre-print cost of the print production and transmits such information to the print charge tracking system 166 as was described above.

Once the print production of the document by the image forming device is completed, then the print cost generator 143 proceeds to generate a post-print cost of the print production of the document by the image forming device. The print cost generator 143 then proceeds to transmit the post-print cost to the print charge tracking system 166 in the secure charge server 106. The post-print cost is transmitted to the print charge tracking system 166 in a message that also includes the print production identifier, a user account, the user identifier/username, and any other pertinent information. In this respect, the print production identifier and the user identifier/username are associated with the post-print cost. The message that includes the post-print cost and other information may be generated using an appropriate language or syntax such as, for example, XML or other language or syntax.

Meanwhile, when the print charge tracking system 166 first receives the pre-print cost from either the client 109 or the image forming device 103, it stores the pre-print cost in an appropriate portion of the memory 156, as stated above. In addition, the print charge tracking system 166 tracks the amount of time the pre-print cost has been stored in the memory 156.

Assuming that the post-print cost is transmitted to the print charge tracking system 166 after the print production is completed, then the print charge tracking system 166 proceeds to match the post-print cost with the pre-print cost stored in the memory 156. The match may be determined by drawing an association between the user identifiers, user accounts, or print production identifiers associated with the pre-print cost and the post-print cost. Once the post-print cost is matched with the pre-print cost, then it is apparent that the print production of the document was successfully completed and that the post-print cost reflects an accurate cost of performing the print production itself. Consequently, the print charge tracking system 166 charges the post-print cost to the user 116. To identify the user 116, the print charge tracking system 166 examines the user account, user identifier, or username that is associated with the post-print cost.

For example, assuming that the user account includes a certain amount of money or provides credit up to a specific limit, then such an account may be debited or charged, accordingly. Alternatively, the print charge tracking system 166 may be configured to automatically generate an invoice that is mailed to the user 116 either by using email or via regular post office mail, as can be appreciated by those with ordinary skill in the art. In this scenario, the user has not interfered with the generation of the post-print costs and so the post-print cost is charged to the user for the completed print production of the document.

Unfortunately, as previously mentioned, some users may wish to interfere with the generation of the post-print cost in the image forming device 103. For example, the user may attempt to delete such post-print costs illicitly from the memory 126 in the image forming device 103 or otherwise impede the generation of such post-print costs. Alternatively, the user may attempt to stop the generation of the post-print cost by shutting down the image forming device 103 itself.

Assuming that the post-print cost is not available as it has yet to be received by the print charge tracking system 166, then the print charge tracking system 166 takes steps to charge the pre-print cost to the user 116. Specifically, as was stated before, the print charge tracking system 166 tracks the amount of time that the pre-print cost is stored in the memory 156. If the pre-print cost has been stored in the memory 156 for a predefined period of time without the post-print cost becoming available to be matched with the pre-print cost, then the print charge tracking system 166 proceeds to charge the pre-print cost to the user with the assumption that the user has somehow interfered with the generation of the post-print cost.

In this respect, the predetermined period of time is a time-out period by which it would ordinarily be assumed that the post-print cost would have been generated by the image forming device 103 and transmitted to the print charge tracking system 166. Such period of time may be, for example, a period of several hours, days, or other time period as is deemed appropriate. In addition, the print charge tracking system 166 may alert a user 116 that the pre-print cost has been charged to the user 116 if the pre-print cost has been stored in the memory for the predefined period of time without the post-print cost becoming available.

In this respect, the print charge tracking system 166 may automatically generate an email that is transmitted to an address on the network 113 that is associated with the user account to inform the user of the assessment of the pre-print cost. Thus, a user may be provided with a mechanism to inform the operators of the image forming device 103 and the secure charge server 106 of any errors in the assessment of a pre-print cost for whatever reason. By tracking the time that the pre-print cost is stored in the memory 156, the print charge tracking system 166 advantageously insures that a charge is generated for each print production performed by the image forming device 103 regardless of the actions taken by a user 116 to thwart the assessment of the post-print cost.

In addition, the print cost generator 143 may cause a message to be displayed on a display associated with the image forming device 103 that informs the user 116 of the estimated pre-print cost for the print production at the same time such information is transmitted to the print charge tracking system 166. Similarly, the client pre-print cost estimator 193 may also display such information on a display device associated with the client 109 when a document is transmitted to the image forming device 103 for print production as well. In this manner, a user may be made aware of the estimated cost that may ultimately be assessed for the print production itself if the post-print cost is not determined. Consequently, if such cost is assessed instead of the post-print cost due to illicit behavior on the part of the user 116, they will have been apprised of such a fact beforehand. This negates any claims that the user did not know that there would be a cost for the print production of the document. Also, a message may be displayed that informs the user 116 that they will be charged the pre-print cost if a post-print cost is not generated by the image forming device 103. This would deter a user from attempting to interfere with the operation of the image forming device 103.

Next, flow charts are discussed that provide examples of the operation of the print cost generator 143, the client pre-print cost estimator 193, and the print charge tracking system 166 according to various embodiments of the present invention.

Figure 2:
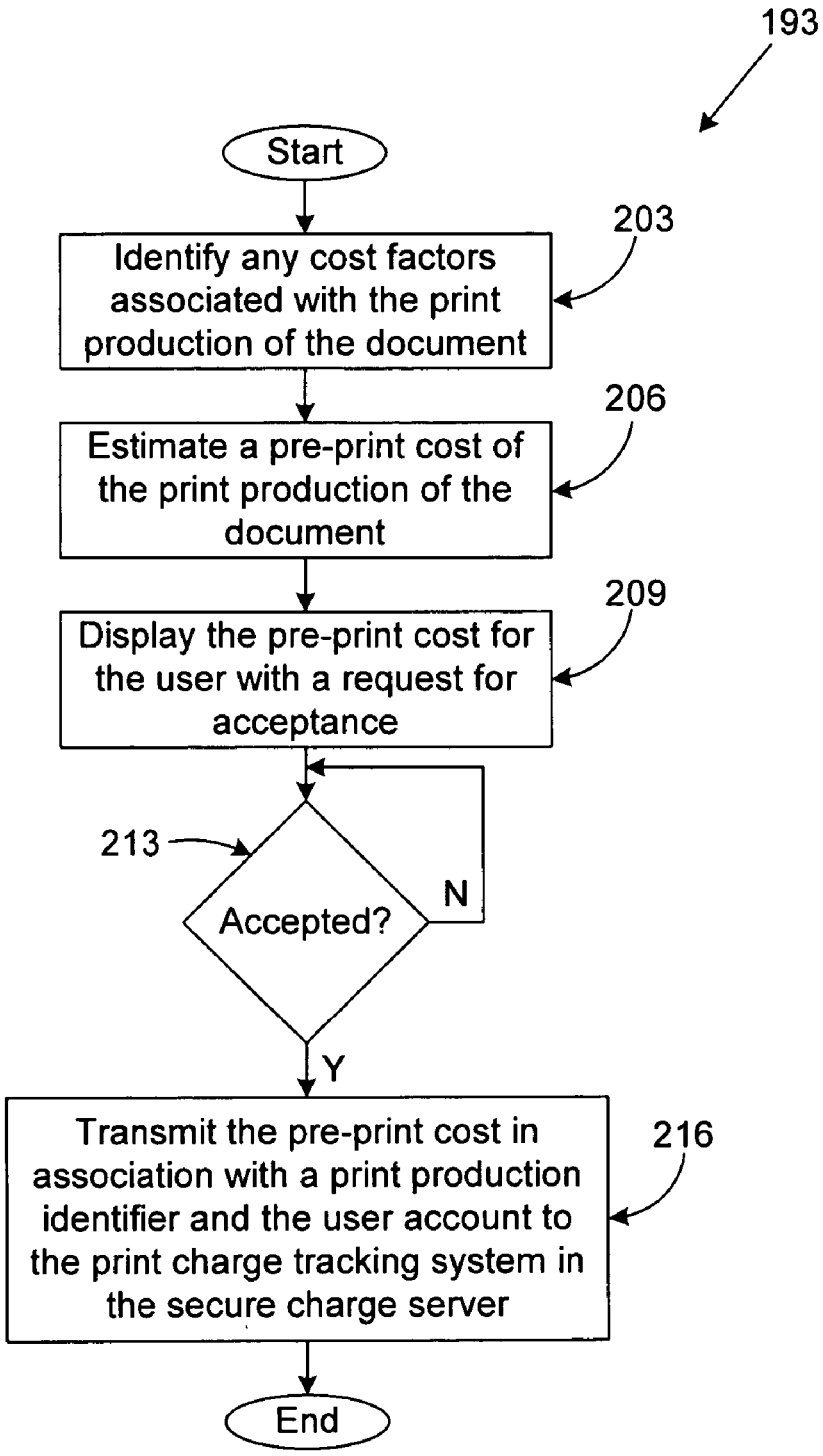
FIG. 2 is a flow chart that provides one example of the operation of a client pre-print cost estimator implemented in the print production network according to an embodiment of the present invention.

Referring next to FIG. 2, shown is a flow chart that provides one example of the operation of the client pre-print cost estimator 193, according to an embodiment of the present invention. Alternatively, the flow chart of FIG. 2 may be viewed as depicting steps of an example of a method implemented in the client 109 (FIG. 1) to estimate a pre-print cost of the print production of the document by the image forming device 103 (FIG. 1). The functionality of the client pre-print cost estimator 193, as depicted by the example flow chart of FIG. 2, may be implemented, for example, in an object oriented design or in some other programming architecture. Assuming the functionality is implemented in an object oriented design, then each block represents functionality that may be implemented in one or more methods that are encapsulated in one or more objects. The client pre-print cost estimator 193 may be implemented using any one of a number of programming languages such as, for example, C, C++, JAVA, Perl, or other programming languages.

Beginning with box 203, the client pre-print cost estimator 193 first identifies the cost factors that are associated with the print production of the document that is to be performed by the image forming device 103. Such cost factors may be stored in the memory 176 (FIG. 1) as a portion of the client pre-print cost estimator 193. Thereafter, in box 206, an estimate of the pre-print cost is calculated based upon the relevant cost factors. Then, in box 209, the pre-print cost is displayed on a display device associated with the client 109 along with a warning that the pre-print cost will be accessed for the print production of the document if the post-print cost is prevented from being generated by the image forming device 103.

Next, in box 213, the client pre-print cost estimator 193 waits for a user 116 (FIG. 1) to indicate their acceptance of the estimate of the pre-print cost and their willingness to proceed with the print production of the document. At this point, the user 116 may wish to cancel the print production of the document if so desired. In such case, the client pre-print cost estimator 193 would end accordingly.

Assuming that the user 116 has indicated a willingness to proceed in box 213, then in box 216 the client pre-print cost estimator 193 generates a message that includes the pre-print cost, the user account, username, user identifier, print production identifier, and any other pertinent information and transmits the message to the print charge tracking system 166. The message may be created using any appropriate language or syntax such as, for example, extensible markup language (XML) or other language or syntax. Thereafter, the client pre-print cost estimator 193 ends as shown.

Figure 3:
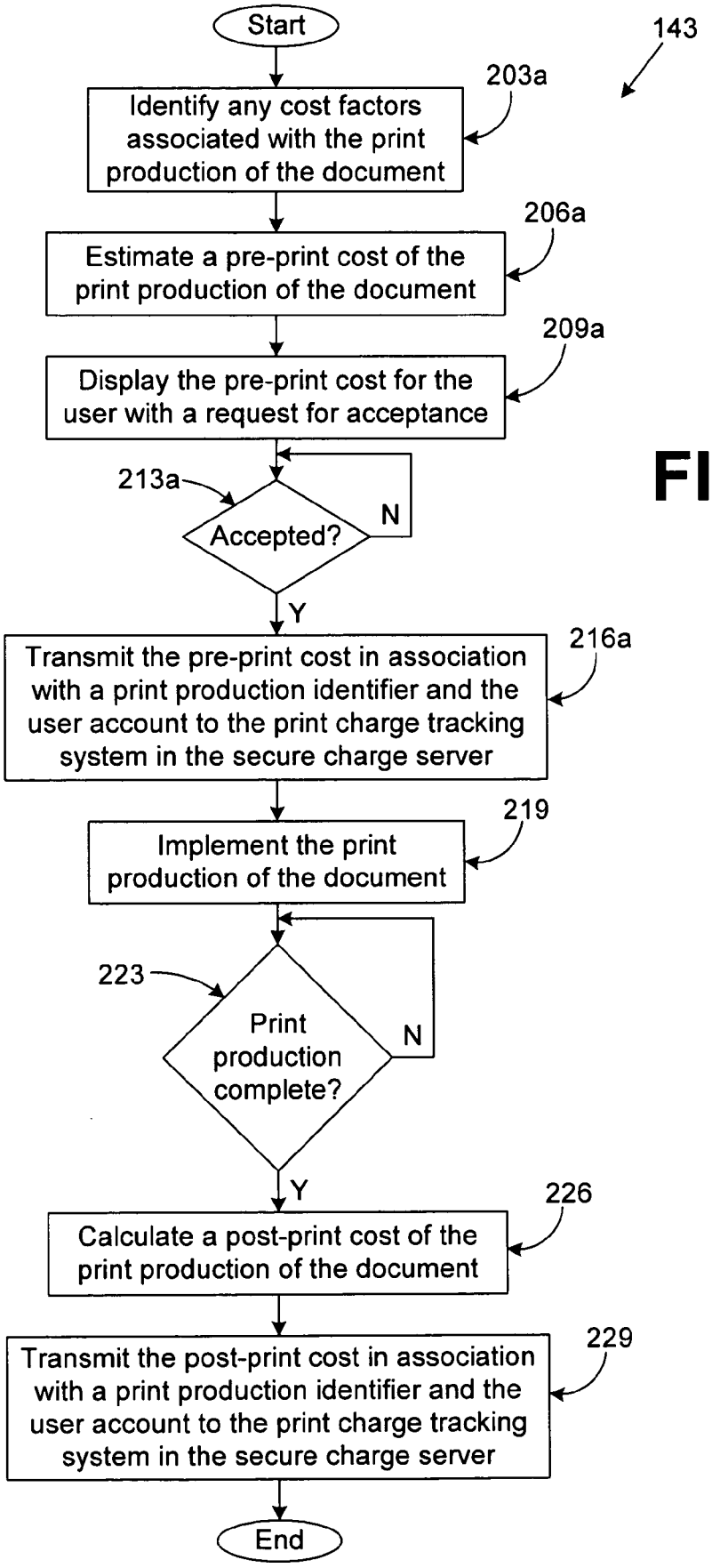
FIG. 3 is a flow chart that provides one example of the operation of a print cost generator implemented in an image forming device in the print production network according to an embodiment of the present invention.

Referring next to FIG. 3, shown is a flow chart that provides one example of the operation of the print cost generator 143, according to an embodiment of the present invention. Alternatively, the flow chart of FIG. 3 may be viewed as depicting steps of an example of a method implemented in the image forming device 103 to generate the pre-print and post-print costs, and to perform other tasks as will be described. The functionality of the print cost generator 143 as depicted by the example flow chart of FIG. 3 may be implemented, for example, in an object-oriented design or in some other programming architecture. Assuming the functionality is implemented in an object oriented design, then each block represents functionality that may be implemented in one or more methods that are encapsulated in one or more objects. The print cost generator 143 may be implemented using any one of a number of programming languages such as, for example, C, C++, JAVA, Perl, or other programming languages.

Beginning with box 203*a*, the print cost generator 143 first identifies the cost factors that are associated with the print production of the document that is to be performed by the image forming device 103. Such cost factors may be stored in the memory 126 (FIG. 1) as a portion of the print cost generator 143. Thereafter, in box 206*a*, an estimate of the pre-print cost is calculated based upon the relevant cost factors. Then, in box 209*a*, the pre-print cost is displayed on a display device associated with the image forming device 103, along with a warning that the pre-print cost will be accessed for the print production of the document if the post-print cost is prevented from being generated by the image forming device 103.

Next, in box 213*a*, the print cost generator 143 waits for a user 116 (FIG. 1) to indicate their acceptance of the estimate of the pre-print cost and their willingness to proceed with the print production of the document. At this point, the user 116 may wish to cancel the print production of the document if so desired. In such case, the print cost generator 143 would end accordingly.

Assuming that the user 116 has indicated a willingness to proceed in box 213*a*, then in box 216*a* the print cost generator 143 generates a message that includes the pre-print cost, the user account, username, user identifier, print production identifier, and any other pertinent information and transmits the message to the print charge tracking system 166 (FIG. 1). The message may be created using any appropriate language or syntax such as, for example, extensible markup language (XML) or other language or syntax.

Next, in box 219, the print cost generator 143 implements the print production of the document by the image forming device 103. In this respect, the print cost generator 143 may interface with other portions of the image forming device control logic 139 to implement the print production of the document. Then, in box 223, the print cost generator 143 waits until the print production is complete. The determination as to whether the print production is complete may depend, for example, upon whether other portions of the image forming device control logic 139 has informed the print cost generator 143 that the print production of the document is complete. This may be the case, for example, if the print production of the document has been finished in its entirety or if the user 116 cancels the print production before it has been completed in it entirety.

Assuming that it is determined that the print production is completed in box 223, then in box 226 the post-print cost of the print production of the document is calculated. In this respect, the post-print cost may be calculated based upon actual use of consumables such as print media, marking agents, finishing components, and other cost factors as described above. Then, in box 229, the post-print cost is transmitted to the print charge tracking system 166. In particular, the print cost generator 143 generates a message that includes the post-print cost and other associated information such as the print production identifier, user account, username, user identifier, or other pertinent information. The message may be created using any appropriate language or syntax such as, for example, extensible markup language (XML) or other language or syntax. Thereafter, the print cost generator 143 ends as shown.

Figure 4:
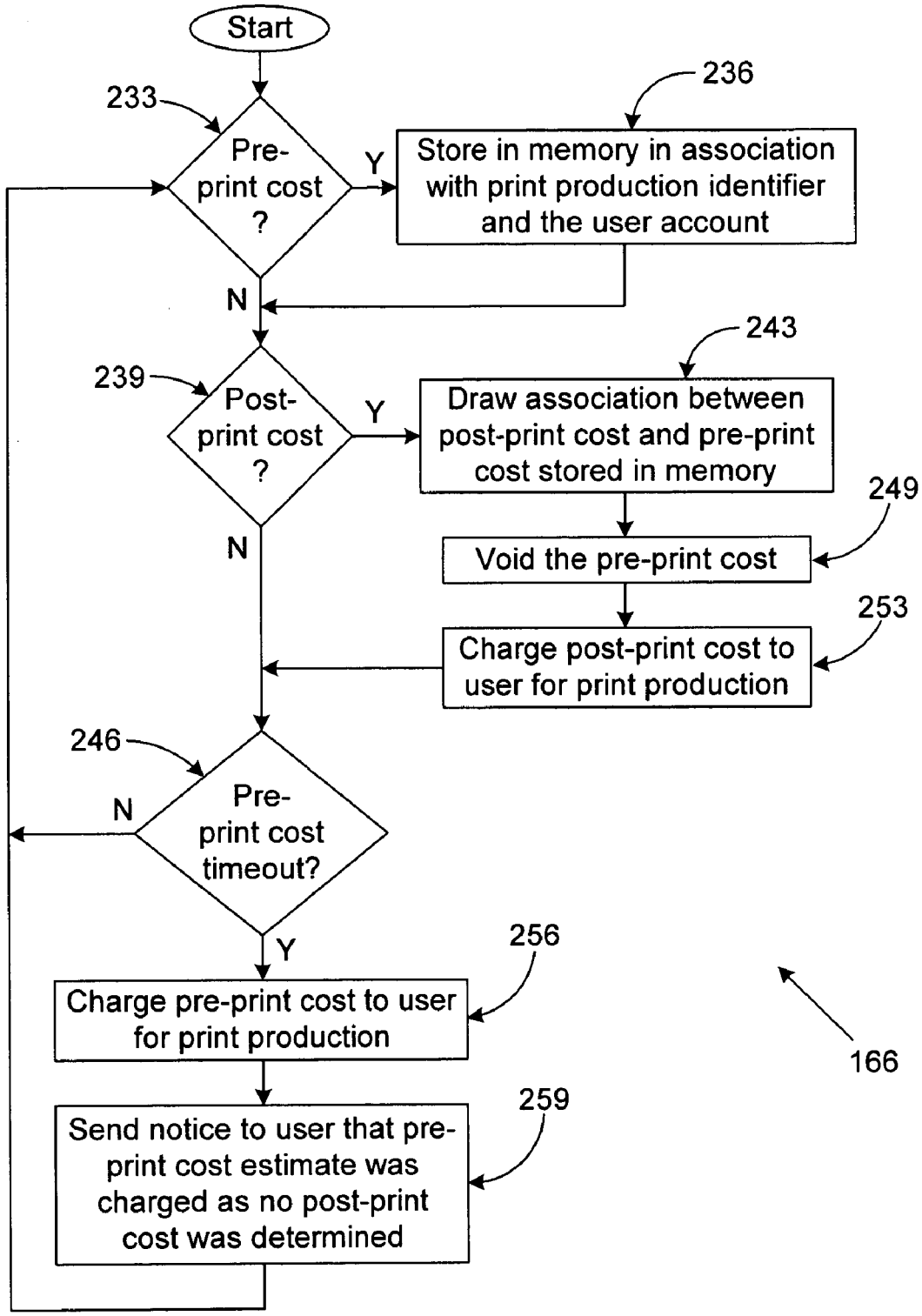
FIG. 4 is a flow chart that provides one example of the operation of a print charge tracking system implemented in a secure charge server in the print production network according to an embodiment of the present invention.

With reference to FIG. 4, shown is a flow chart that provides one example of the operation of the print charge tracking system 166, according to an embodiment of the present invention. Alternatively, the flow chart of FIG. 4 may be viewed as depicting steps of an example of a method implemented in the secure charge server 106 to charge a user for a print production of a document on the image forming device 103 (FIG. 1). The functionality of the print charge tracking system 166, as depicted by the example flow chart of FIG. 4, may be implemented, for example, in an object-oriented design or in some other programming architecture. Assuming the functionality is implemented in an object oriented design, then each block represents functionality that may be implemented in one or more methods that are encapsulated in one or more objects. The print charge tracking system 166 may be implemented using any one of a number of programming languages such as, for example, C, C++, JAVA, Perl, or other programming languages.

Beginning with box 233, the print charge tracking system 166 determines whether a pre-print cost has been received from either the image forming device 103 or the client 109. In this respect, the pre-print cost may be embodied in an appropriate message using an appropriate programming or markup language, as was described above. In order to assist in the recognition of the message itself, the print charge tracking system 166 may employ an appropriate parser (such as, for example, an XML parser) to extract the pre-print cost and other pertinent information from the message itself. Assuming that a pre-print cost is received in box 233, then print charge tracking system 166 then proceeds to box 236. Otherwise, the print charge tracking system 166 moves to box 239.

In box 236, the print charge tracking system 166 then stores the pre-print cost in an appropriate portion of the memory 156 in association with the print production identifier and the user account username. Thereafter, the print charge tracking system 166 proceeds to box 239.

In box 239, the print charge tracking system 166 determines whether a post-print cost has been received from the image forming device 103 indicating a completion of the print production of the document. If such is the case, then the print charge tracking system 166 proceeds to box 243 in which the print production draws an association between the post-print cost and the pre-print cost stored in the memory 156 to find the pre-print cost stored in the memory 156 (FIG. 1) that is associated with the print production for which the post-print cost was generated. If a corresponding pre-print cost is not found, then the print charge tracking system 166 indicates an error to an appropriate operator.

Once an association is drawn between the pre-print and post-print costs in box 243, the print charge tracking system 166 voids the pre-print cost in the memory 156. This may be done, for example, by marking the pre-print cost in the memory so that it is not charged to a user since the post-print cost for the respective print production is available. It is desirable to charge the post-print cost to the user rather than the pre-print cost as it potentially provides a more accurate cost of the print production of the document. For example, the user may cancel the full print production of the document in the middle of the print production itself. As such, less than the total estimated number of pages of the print production may be produced. In this situation, the post-print cost potentially may be much less than the pre-print cost.

From box 249, the print charge tracking system 166 proceeds to box 253 in which the print charge tracking system 166 charges the post-print cost to the user for the print production of the document. This is done because the post-print cost is available before the pre-print cost has been stored in the memory for a predefined period of time (i.e. the pre-print cost has not timed out). Thereafter, the print charge tracking system 166 proceeds to box 246.

Assuming that the print charge tracking system 166 has proceeded to box 246, then it determines if the pre-print cost has been stored in the memory for a predefined period of time. The predefined period of time is specified so as to give ample time for the completion of the print production of the document by the image forming device 103. Thus, once the predefined period of time has elapsed without receiving the post-print cost, it is assumed that the post-print cost is not forth coming due to the possibility that a user has tampered with the operation of the image forming device 103 as described above. If the print charge tracking system 166 determines that the pre-print cost has been stored in the memory 156 for the predefined period of time without the post-print cost becoming available in box 246, then the print charge tracking system 166 proceeds to box 256. Otherwise, the print charge tracking system 166 reverts back to box 233.

In box 256, the pre-print cost is charged to the user for the print production of the document. Thereafter, in box 259 the print charge tracking system 166 transmits a notice or an alert to the user that the pre-print cost has been charged to the user as no post-print cost was available within the predefined period of time that the pre-print cost was stored in the memory 156. Thereafter, the print charge tracking system 166 reverts back to box 233 as shown.

In addition, it is understood that there may be multiple pre-print costs stored in the memory 156 that are associated with a corresponding number of print productions of documents that are to be performed by the image forming device 103. In this respect, the image forming device 103 may include an input queue that stores multiple print productions to be performed, where the print cost generator 143 generates an estimate of the pre-print cost of each print production as it is received and stored in the input queue. Alternatively, the print cost generator 143 may be configured to generate a single pre-print cost for a device at a time when it is to be printed by the image forming device 103.

Although the print cost generator 143, print charge tracking system 166, and the client pre-print cost estimator 193 are each embodied in software or code executed by general purpose hardware as discussed above, as an alternative each may also be embodied in dedicated hardware or a combination of software/general purpose hardware and dedicated hardware. If embodied in dedicated hardware, the print cost generator 143, print charge tracking system 166, and the client pre-print cost estimator 193 each may be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, programmable gate arrays (PGA), field programmable gate arrays (FPGA), or other components, etc. Such technologies are generally well known by those skilled in the art and, consequently, are not described in detail herein.

The flow charts of FIGS. 2–4 show examples of the architecture, functionality, and operation of an implementation of the print cost generator 143, print charge tracking system 166, and the client pre-print cost estimator 193. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor in a computer system or other system. The machine code may be converted from the source code, etc. If embodied in hardware, each block may represent a circuit or a number of interconnected circuits to implement the specified logical function(s).

Although flow charts of FIGS. 2–4 show a specific order of execution, it is understood that the order of execution may differ from that which is depicted. For example, the order of execution of two or more blocks may be scrambled relative to the order shown. Also, two or more blocks shown in succession in FIGS. 2–4 may be executed concurrently or with partial concurrence. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present invention.

Also, where the print cost generator 143, print charge tracking system 166, or the client pre-print cost estimator 193 comprises software or code, each can be embodied in any computer-readable medium for use by or in connection with an instruction execution system such as, for example, a processor in a computer system or other system. In this sense, the logic may comprise, for example, statements including instructions and declarations that can be fetched from the computer-readable medium and executed by the instruction execution system. In the context of the present invention, a "computer-readable medium" can be any medium that can contain, store, or maintain the print cost generator 143, print charge tracking system 166, or the client pre-print cost estimator 193 for use by or in connection with the instruction execution system. The computer readable medium can comprise any one of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, or compact discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

Although the invention is shown and described with respect to certain embodiments, it is obvious that equivalents and modifications will occur to others skilled in the art upon the reading and understanding of the specification. The present invention includes all such equivalents and modifications, and is limited only by the scope of the claims.

What is claimed is:

1. A print production cost accounting method, comprising the steps of:

storing in a memory a pre-print cost of a print production of a document by an image forming device;

initiating the print production of the document by the image forming device after the pre-print cost is stored in the memory;

generating a post-print cost of the print production of the document by the image forming device if the print production of the document is completed; and charging a user the post-print cost if the post-print cost is available before the pre-print cost has been stored in the memory for a predefined period of time.

2. The print production cost accounting method of claim 1, further comprising the step of estimating the pre-print cost of the print production of the document by the image forming device.

3. The print production cost accounting method of claim 2, wherein the step of estimating the pre-print cost of the print production of the document by the image forming device is performed in a client that is in data communication with the image forming device.

4. The print production cost accounting method of claim 1, further comprising the step of charging a user the pre-print cost if the post-print cost is not available before the pre-print cost has been stored in the memory for the predefined period of time.

5. The print production cost accounting method of claim 4, further comprising the step of alerting a user that the pre-print cost has been charged to the user if the post-print cost is not available before the pre-print cost has been stored in the memory for the predefined period of time.

6. The print production cost accounting method of claim 1, wherein the step of estimating the pre-print cost of the print production of the document by the image forming device is performed in the image forming device.

7. The print production cost accounting method of claim 6, wherein the step of estimating the pre-print cost of the print production of the document by the image forming device further comprises the step of estimating a number of pages in the document disposed in a stack in an input bin of the image forming device.

8. The print production cost accounting method of claim 1, wherein the step of estimating the pre-print cost of the print production of the document by the image forming device is performed based upon at least one cost factor associated with the print production of the document taken from a group of cost factors consisting of:

a number of pages of the document;

a type of a print media designated for use in the print production;

a size of the print media;

an estimated amount of at least one marking agent that may be employed in the print production; and a finishing operation performed as part of the print production.

9. A program embodied in a computer readable medium for print production cost accounting, comprising:

code that stores in a memory a pre-print cost of a print production of a document by an image forming device;

code that charges a post-print cost to a user if the post-print cost is available before the pre-print cost has been stored in the memory for a predefined period of time; and code that charges the pre-print cost to the user if the post-print cost is not available before the pre-print cost has been stored in the memory for the predefined period of time.

10. The program embodied in a computer readable medium of claim 9, further comprising code that transmits an alert to the user that the pre-print cost has been charged to the user if the post-print cost is not available before the pre-print cost has been stored in the memory for the predefined period of time.

11. The program embodied in a computer readable medium of claim 9, wherein the pre-print cost is generated in a client.

12. The program embodied in a computer readable medium of claim 9, wherein the pre-print cost is generated in the image forming device.

13. A system for print production cost accounting, comprising:

a processor circuit having a processor and a memory;

a print charge tracking system stored in the memory and executable by the processor, the print charge tracking system comprising:

logic that stores in the memory a pre-print cost of a print production of a document by an image forming device;

logic that charges a post-print cost to a user if the post-print cost is available before the pre-print cost has been stored in the memory for a predefined period of time; and logic that charges the pre-print cost to the user if the post-print cost is not available before the pre-print cost has been stored in the memory for the predefined period of time.

14. The system of claim 13, further comprising logic that transmits an alert to the user that the pre-print cost has been charged to the user if the post-print cost is not available before the pre-print cost has been stored in the memory for the predefined period of time.

15. The system of claim 13, wherein the pre-print cost is generated in a client.

16. The system of claim 13, wherein the pre-print cost is generated in the image forming device.

17. A system for print production cost accounting, comprising:

means for storing in a memory a pre-print cost of a print production of a document by an image forming device;

means for charging a post-print cost to a user if the post-print cost is available before the pre-print cost has been stored in the memory for a predefined period of time; and means for charging the pre-print cost to the user if the post-print cost is not available before the pre-print cost has been stored in the memory for the predefined period of time.

18. The system of claim 17, further comprising means for transmitting an alert to the user that the pre-print cost has been charged to the user if the post-print cost is not available before the pre-print cost has been stored in the memory for the predefined period of time.

* * * * *